US007786417B2

(12) United States Patent
Sells, II

(10) Patent No.: US 7,786,417 B2
(45) Date of Patent: Aug. 31, 2010

(54) RAM NEUTRALIZATION SYSTEM AND METHOD

(75) Inventor: Harold R. Sells, II, Huntsville, AL (US)

(73) Assignee: Dese Research, Inc., Huntsville, AL (US)

( * ) Notice: Subject to any disclaimer, the term of this patent is extended or adjusted under 35 U.S.C. 154(b) by 224 days.

(21) Appl. No.: 11/636,922

(22) Filed: Dec. 11, 2006

(65) Prior Publication Data

US 2009/0114761 A1 May 7, 2009

(51) Int. Cl.

| | |
|---|---|
| ***B64D 1/04*** | (2006.01) |
| ***F42B 30/00*** | (2006.01) |
| ***F42B 15/10*** | (2006.01) |
| *F42B 15/00* | (2006.01) |

(52) U.S. Cl. ..... 244/3.1; 89/1.1; 89/1.11; 102/400; 102/401; 102/402; 102/403; 102/405; 102/501; 102/502; 102/504

(58) Field of Classification Search ..... 244/3.1–3.3; 89/1.11, 1.1, 1.13; 102/401–405, 430, 439, 102/500, 501–505; 114/240 R, 241, 240 A–240 E; 342/5–11; 86/1.1

See application file for complete search history.

(56) References Cited

U.S. PATENT DOCUMENTS

| | | | | | |
|---|---|---|---|---|---|
| 3,568,191 | A | * | 3/1971 | Hiester et al. | 342/8 |
| 3,766,880 | A | * | 10/1973 | Ramsey et al. | 114/241 |
| 4,768,417 | A | * | 9/1988 | Wright | 89/1.11 |
| 4,867,357 | A | | 9/1989 | Inglis et al. | |
| 5,069,109 | A | * | 12/1991 | Lavan, Jr. | 89/1.11 |
| 5,417,139 | A | * | 5/1995 | Boggs et al. | 89/1.11 |
| 5,583,311 | A | * | 12/1996 | Rieger | 89/1.11 |
| 5,710,423 | A | | 1/1998 | Biven et al. | |
| 5,750,918 | A | * | 5/1998 | Mangolds et al. | 102/439 |
| 5,898,125 | A | * | 4/1999 | Mangolds et al. | 102/439 |
| 5,988,036 | A | * | 11/1999 | Mangolds et al. | 86/1.1 |
| 6,510,776 | B2 | | 1/2003 | Sirmalis et al. | |
| 6,626,077 | B1 | * | 9/2003 | Gilbert | 89/1.11 |
| 6,771,205 | B1 | | 8/2004 | Barton et al. | |
| 6,904,838 | B1 | * | 6/2005 | Dindl | 89/1.1 |
| 6,957,602 | B1 | * | 10/2005 | Koenig et al. | 89/1.11 |
| 6,990,885 | B2 | | 1/2006 | Boyd | |
| 7,328,644 | B2 | | 2/2008 | Vickroy | |
| 2006/0169832 | A1 | * | 8/2006 | Glasson | 244/3.1 |

FOREIGN PATENT DOCUMENTS

GB 2172853 A * 10/1986

OTHER PUBLICATIONS

A. Parsch, "HOE"; posted on the Internet at astronautix.com; no date listed.*

(Continued)

*Primary Examiner*—Bernarr E Gregory
(74) *Attorney, Agent, or Firm*—Stephen H. Hall; Jeremy A. Smith; Bradley Arant Boult Cummings LLP

(57) ABSTRACT

An article for neutralizing an enemy weapon comprising an interceptor and a deployable net attached to the interceptor, said deployable net remaining attached to the interceptor upon deployment, is disclosed. A method of neutralizing an airborne enemy weapon comprising launching an interceptor, with a capture sock, towards the enemy weapon and deploying the capture sock just prior to the interceptor encountering the enemy weapon is also disclosed. The capture sock remains attached to the interceptor upon deployment.

8 Claims, 5 Drawing Sheets

OTHER PUBLICATIONS

P. Russell, "Anti-Torpedo Nets"; no date listed; posted on the Internet at www.gwpda.org.*

Rena Marie Pacella, A Chopper Shield, Popular Science Magazine, Jun. 2007, pp. 54-55, USA.

* cited by examiner

RAM NEUTRALIZATION SYSTEM AND METHOD

BACKGROUND OF THE INVENTION

This invention generally relates to a system and method for intercepting rockets, artillery, and mortar for battlefield defense. In particular, the present invention relates to a method and system for neutralizing rockets, artillery, and mortars using a capture sock or net.

Historically, the greatest killer on the battlefield has been rockets, artillery, and mortar, often collectively referred to as RAM. A RAM threat is an extremely difficult target to kill. Using conventional interceptor technology, the interceptor is required to utilize high precision guidance systems to guide the interceptor accurately enough to hit the threat. Moreover, many interceptors utilize warheads to kill the RAM threat and thus require large and sophisticated hardware.

Various guidance systems for interceptors are well-known in the industry. Generally, guidance systems are either "passive", "active", or a combination of "active" and "passive." Passive systems generally collect data from the target for guidance control, and are often referred to as homing guidance. Active systems obtain guidance instructions from a ground based system, for example, a radar tracking station, and are often referred to as command guidance. Any conventional guidance system can be used for the interceptor system and method disclosed herein and the type of guidance system used for any particular application is not a limitation of invention.

Most interceptors also utilize some type of steering device that allows the trajectory and flight of the interceptor to be altered during flight. Steering devices, and the guidance systems that control the steering devices, are well known in the industry. Any conventional steering device can be used for the interceptor system and method disclosed herein and the type of steering mechanism used for any particular application is not a limitation of the invention.

Some existing interceptors incorporate devices and systems to increase the interceptor's ability to hit the RAM threat. For example, the interceptor may incorporate an explosive warhead that detonates when the interceptor is in close proximity to the RAM, destroying the RAM in the blast. Alternatively, the interceptor may deploy a "fan" or "blades", for example steel blades, to increase the coverage area of the interceptor when it encounters the RAM.

Even when an interceptor hits a RAM, it is extremely difficult to disable or destroy the RAM. For example, the thick case of the mortar and artillery rounds require large amounts of energy transfer from the interceptor in order to effect a "kill" that renders the unit harmless. Unfortunately, in some circumstances when a RAM is "killed", shrapnel or debris from the RAM or the interceptor may still cause collateral damage.

Thus the success of the battle is often decided by economics—the cost and size of the interceptor and supporting fire control components are very high making the cost per RAM kill unacceptable. Indeed, as the acceptable miss distance of a particular intercept system (i.e., how close the interceptor must come to the RAM to enable it to destroy or disable the RAM) decreases, the cost of the intercept system goes up exponentially due to the complexity and sophistication of the guidance componentry. The enemy's ability to proliferate the low-cost, low complexity RAM threat easily counters a defense capability that is complex and expensive.

It is, therefore, desirable to provide a RAM neutralization system and method that increases the acceptable miss distance of an intercept system and requires less expensive guidance systems. It is further desirable to provide a RAM neutralization system and method that does not need to actually hit the RAM in order to neutralize it. It is further desirable to provide an RAM neutralization system and method that does not require the RAM to be detonated in order to be neutralized.

SUMMARY OF THE INVENTION

The present invention recognizes and addresses various of the foregoing limitations and drawbacks, and others, regarding RAM intercept and neutralization systems and methods. Therefore, the present invention is directed to a RAM neutralization system and method that has a relaxed guidance precision requirement and provides more opportunity to destroy or mitigate the RAM threat.

In one embodiment, the invention is directed to a system for neutralizing an enemy weapon comprising an interceptor launched toward an approaching enemy weapon and a deployable net attached to the interceptor, said net being deployed from the interceptor prior to the interceptor encountering the enemy weapon to capture the enemy weapon.

In another embodiment, the invention is directed to a method of neutralizing an airborne enemy weapon comprising launching an interceptor toward an approaching airborne enemy weapon, said interceptor having a deployable capture sock, deploying the capture sock prior to the interceptor encountering the airborne enemy weapon, and capturing the airborne enemy weapon in the capture sock.

In another embodiment, the invention is directed to a weapon defense system for neutralizing an approaching airborne enemy weapon comprising an interceptor housing a deployable capture sock, wherein the interceptor is launched toward the airborne enemy weapon and deploys the capture sock to capture the airborne enemy weapon.

It is, therefore, a principle object of the subject invention to provide a cost-effective RAM neutralization system and method. More particularly, it is an object of the present invention to provide a RAM neutralization system and method that does not necessarily require high guidance precision. It is another object of the invention to provide for expanded options for destroying or mitigating the RAM threat. It is a further object of the invention to minimize the collateral damage associated with neutralizing a RAM threat.

Generally, the novel RAM neutralization system and method disclosed herein is used in connection with well-known intercept vehicles, guidance systems, and steering devices. When an RAM threat is identified, an interceptor is launched. Those of skill in the art will appreciate and recognize the appropriate intercept vehicles, guidance systems, and steering devices that may be best utilized. Unlike the prior art RAM neutralizing systems and methods, however, the present invention utilizes a capture sock or net to neutralize the RAM. The intercept vehicle includes a capture sock that is deployed just before the intercept vehicle encounters the RAM, the RAM is captured or diverted, and the threat neutralized.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
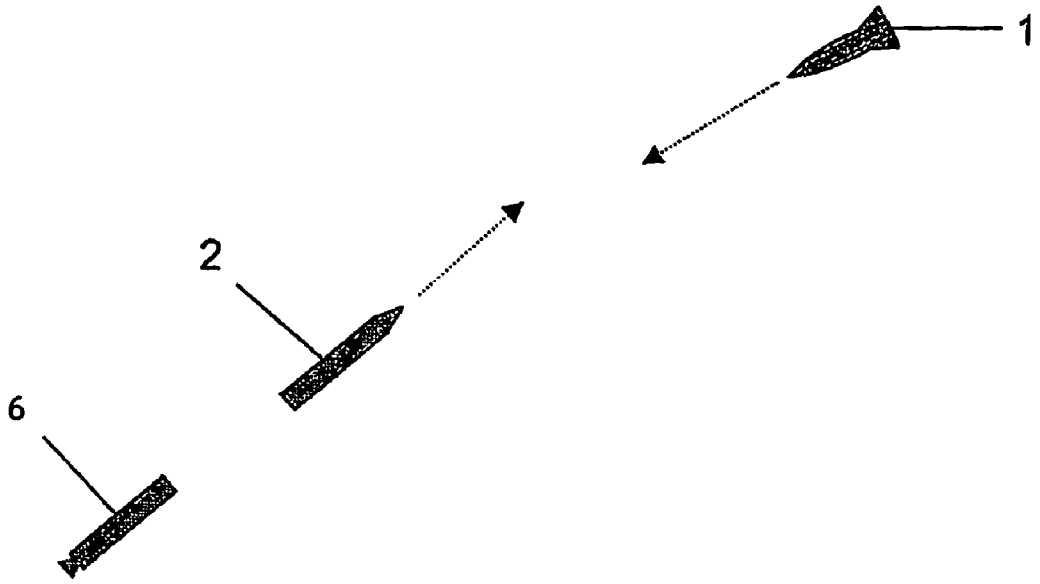
FIG. 1 is a depiction of an interceptor and separated main propulsion stage approaching a RAM threat.

Repeat use of reference characters throughout the present specification and appended drawings is intended to represent the same or analogous features or elements of the invention.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

As disclosed above, the present invention is particularly concerned with a RAM neutralization system and method that utilizes a capture net or sock. As depicted in FIG. 1, a RAM 1 is identified utilizing conventional technology and an interceptor 2 is launched or fired. Again, various interceptors are known in the art and the specific type of interceptor that may be utilized is not a limitation of the invention. One type of interceptor utilizes a main propulsion stage 6, or booster, that accelerates the interceptor 2 toward the RAM 1. The main propulsion stage 6 is normally disengaged, falls off the main interceptor casing, or the main propulsion ceased. The interceptor 2 utilizes well known, and conventional, guidance and steering systems to track and intercept the RAM 1.

Figure 2:
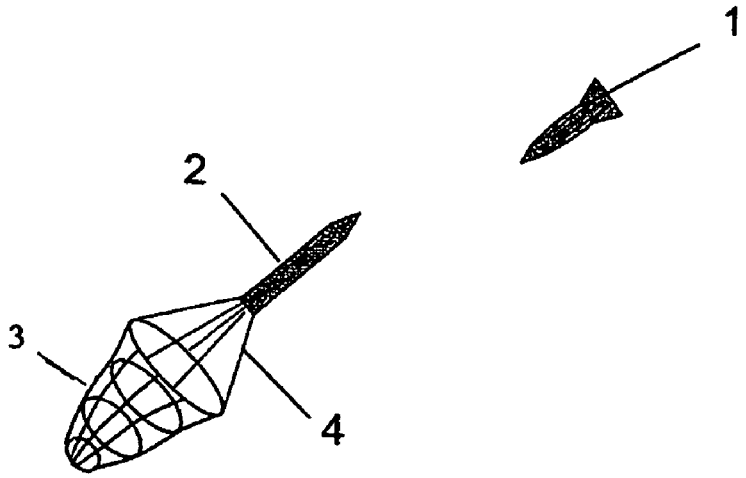
FIG. 2 is a depiction of one embodiment of the capture sock being deployed.

As depicted in FIG. 2, as the interceptor 2 approaches the RAM 1, the interceptor 2 deploys a capture sock 3, or net, just before intercept. In the preferred embodiment, the deployed capture sock 3 is connected to the interceptor 2 by tethers 4, although other connections are contemplated. In the preferred embodiment, the capture sock 3 has a net-like structure having webbing dense enough to at least temporarily capture the RAM 1, but with sufficient spacing to minimize drag. Preferably, the capture sock 3 is made of any sufficiently strong material to capture the RAM 1 without breaking. Preferred embodiments of the capture sock material are made of Kevlar®. The spacing of the capture sock webbing will depend on the specific type of RAM to be neutralized. For example, for artillery and mortars, the spacing may be significantly more dense than for neutralizing rockets because rockets are traditionally larger in size.

Figure 3:
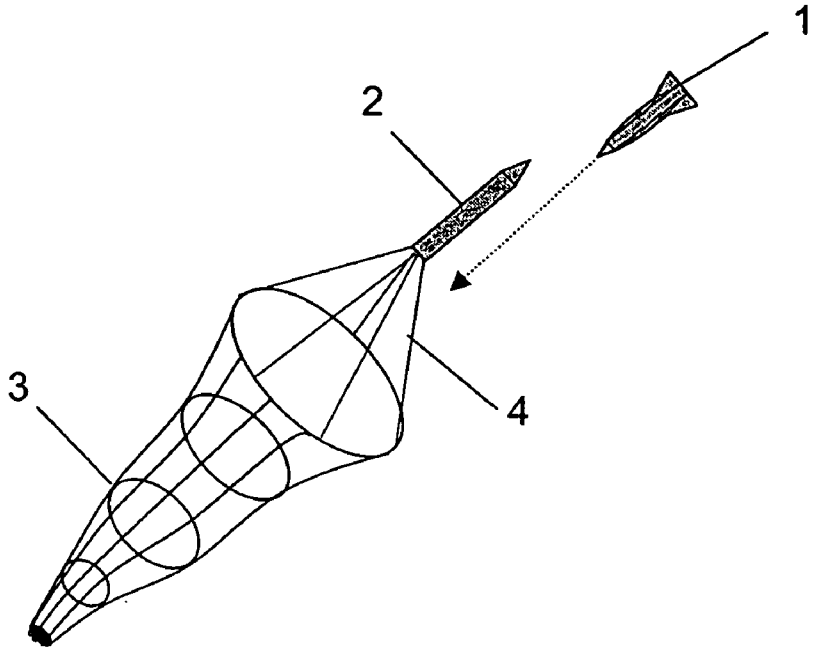
FIG. 3 is a depiction of one embodiment of the capture sock after full deployment.

The deployment of the capture sock 3 may be by any conventional means. When deployed in this embodiment, the capture sock 3 has sufficient drag such that the movement of the air through the capture sock 3 will cause the capture sock 3 to naturally expand to its full volume (see FIG. 3). Alternative active mechanisms may also be utilized to assist the capture sock 3 in expanding, either upon deployment or some other desired time.

The capture sock 3 preferably is in the shape of a tapered cone, such that the opening closest to the interceptor 2 has a larger diameter than the capture point. Alternative configurations of the capture sock 3 may also be used. Indeed, the capture sock, or net, could simply be a two-dimensional web rather than a three-dimensional cone having a length. The size and shape of the capture sock opening is not fixed, and may depend on the specific type of RAM threat being neutralized, the accuracy of the guidance systems being utilized, and the drag of the capture sock 3 when deployed. The larger the capture sock opening, the greater likelihood of capture. However, the larger the capture sock opening, the more drag the interceptor 2 will likely experience when the capture sock 3 is deployed, and the ability to guide the interceptor 2 will decrease.

If the RAM 1 is directly hit by the interceptor 2, the RAM 1 will likely be disabled or destroyed, and the RAM 1 will not likely hit its intended target. Thus, the present system and method may be used in connection with other neutralization systems. If the RAM 1 is not directly hit by the interceptor 2, the relatively large opening of the capture sock 3 allows the present system to nevertheless "neutralize" a RAM 1 even when a direct hit is not achieved. Thus, the present system need not be as highly accurate as the prior art systems.

Figure 4:
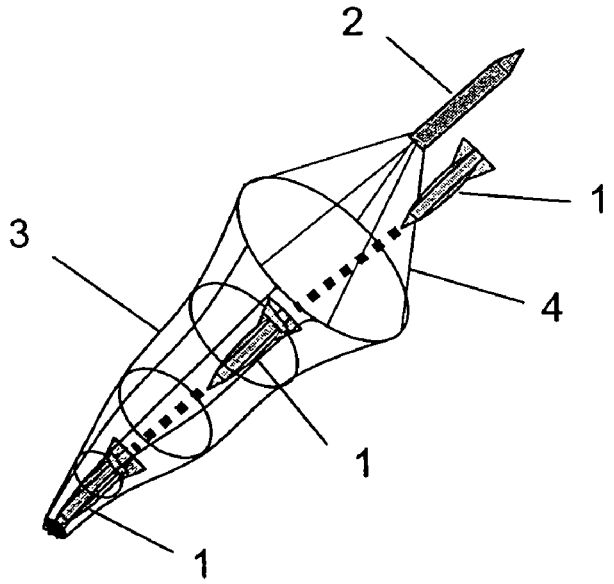
FIG. 4 is a depiction of one embodiment of the capture sock as the RAM is captured by the capture sock.

As depicted in FIG. 4, the RAM 1 passes through the capture sock opening and into the capture sock 3. In the preferred embodiment, the RAM 1 will be contained within the capture sock 3 and will preferably travel to the "closed" end of the capture sock 3. The "closed" end need not be completely closed, but should have webbing sufficiently dense to capture the RAM 1 to be neutralized. For clarity the term "capture" means that the weapon to be neutralized passes through the open end of the capture sock, or otherwise contacts the net. As discussed below, it may be temporarily or permanently captured.

A RAM 1 may be neutralized even if the system does not permanently capture the RAM 1 in the "closed" end of the capture sock 3 as designed. For example, the RAM 1 could detonate when it encounters sufficient resistance in the capture sock 3 before it reaches the "closed" end. Moreover, even if the RAM 1 pierces the capture sock 3 or encounters the capture sock 3 but is nevertheless able to pass through one of the openings in the capture sock webbing, the RAM 1 will often be "neutralized" because the trajectory of the RAM 1 will likely be sufficiently altered so that the RAM 1 does not hit its intended target.

In the preferred embodiment, the RAM 1 will be permanently captured in the capture sock 3 and will travel to the "closed" end of the sock. Again, the "closed" end of the sock preferably has dense enough webbing in the capture sock material so that the RAM 1 does not pass through. Preferably, the material of the capture sock 3 is strong enough to not break when the RAM 1 is encountered. Even if the material is broken, the trajectory of the RAM 1 will likely have been sufficiently altered so that the RAM does not hit its intended target.

Some RAMs 1 initiate a fuse upon an impact and detonate shortly thereafter. Thus, some RAMs 1 may detonate upon impact of the RAM 1 in the sock, particularly in the "closed" end of the sock 3. The "closed" end of the sock may also contain a material different from the webbing of the capture sock 3 that facilitates detonation of the RAM 1 when it hits the "closed" end of the sock 3.

Figure 6:
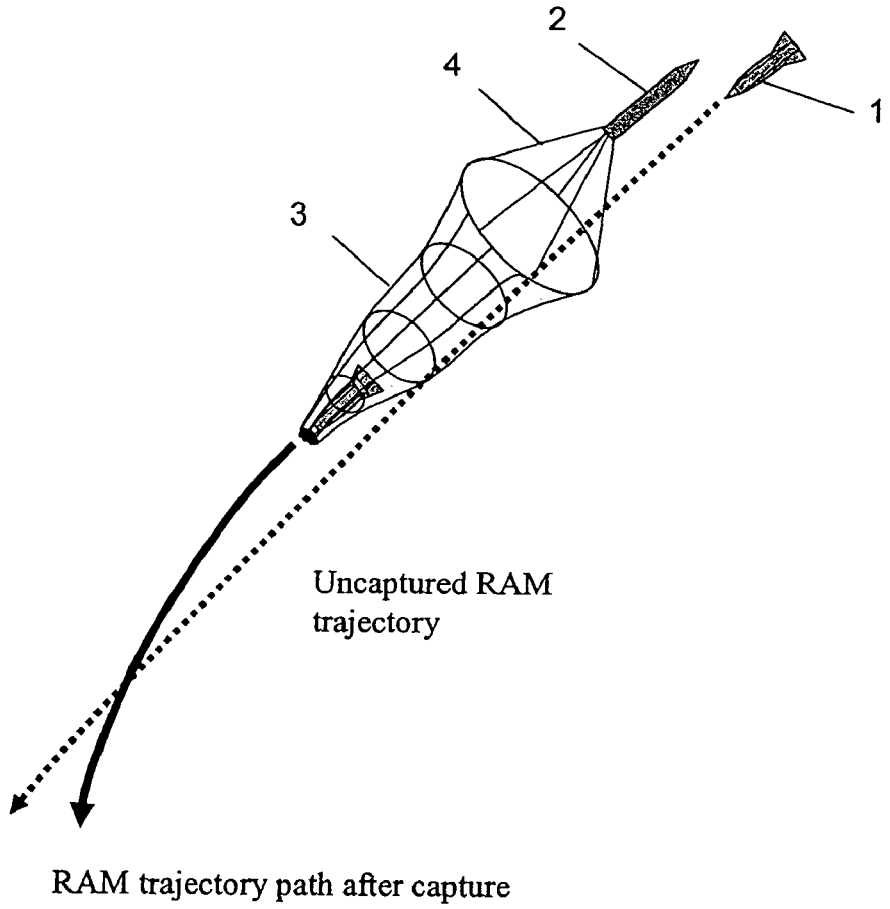
FIG. 6 is a depiction of one embodiment of the capture sock altering the trajectory of the captured RAM.
Figure 7:
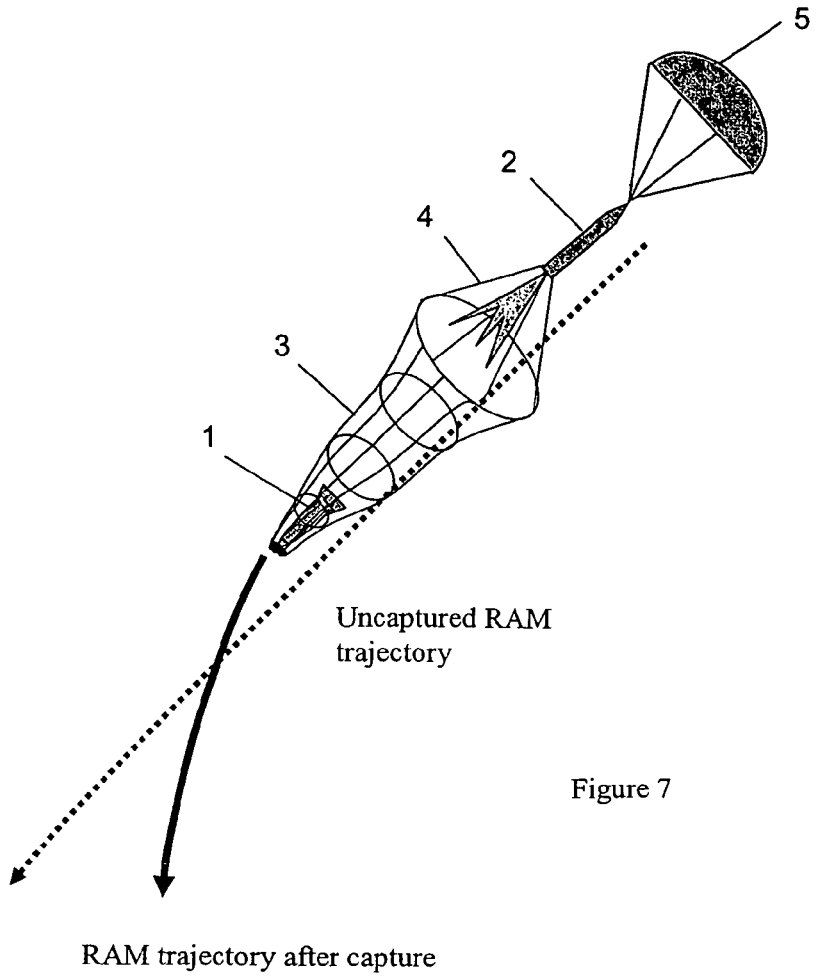
FIG. 7 is a depiction of one embodiment of the capture sock and interceptor utilizing a parachute and/or additional thrust mechanism in the interceptor to alter the trajectory of the captured RAM.

When the RAM 1 is captured, and the capture sock 3 is not pierced, the trajectory of the RAM 1 (now in the capture sock) is significantly affected as depicted in FIG. 6. The capture sock 3 may remain connected to the interceptor 2 or it may be designed to break away from the interceptor. Either way, the RAM 1 will not hit its intended target. This is one way to neutralize the RAM threat. The neutralization system and method may also utilize additional mechanisms to further neutralize the threat. For example, the interceptor 2 may also use a parachute 5 that is deployed that will further alter the trajectory of the RAM 1 after it is captured (see FIG. 7). Similarly, the capture sock 3 could also be designed to deploy a parachute upon capture of the RAM 1. The interceptor 2 may also utilize additional propulsion to further alter the trajectory of the captured RAM 1 (see FIG. 7). These two additional embodiments could be used together, separately, or not at all. Any additional mechanisms which alter the trajectory of the captured RAM 1 may also be used and are within the scope of the invention.

Figure 5:
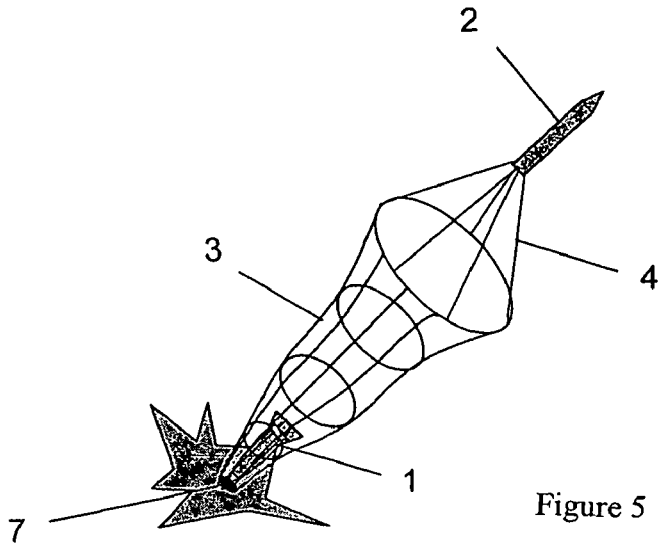
FIG. 5 is a depiction of one embodiment of the capture sock using an active destruct mechanism to neutralize the RAM.

Additional embodiments can be utilized that actively seek to disable or destroy the RAM 1. In one embodiment, the closed end of the capture sock 3 may contain an active destruct mechanism 7 that can further neutralize the RAM 1 (see FIG. 5).

Figure 8:
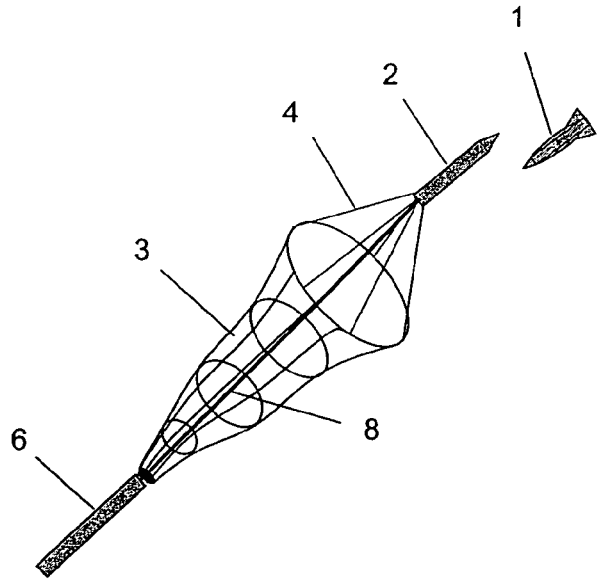
FIG. 8 is a depiction of one embodiment wherein the main propulsion stage and the capture sock remain connected to the interceptor.

Another embodiment is depicted in FIG. 8. In this embodiment, the main propulsion stage 6, or booster, is not totally disengaged, but rather remains connected to the interceptor 2. Depicted in FIG. 8 is one embodiment showing use of an interceptor 2/booster 6 tether 8 that extends to approximately the closed end of the sock. The capture sock 3 is deployed as discussed above. Thus, both the capture sock 3 and the main propulsion stage 6 are connected to the interceptor 2. In the preferred embodiment, the "closed end" of the capture sock 3 terminates into the connected main propulsion stage 6. This embodiment has two advantages. First, the presence of the main propulsion stage 6 provides a solid "structure" that will likely detonate the RAM 1 when the RAM 1 contacts it. Second, the main propulsion stage 6 may also contain a separate warhead or explosive device to actively detonate the RAM 1.

Figure 9A:
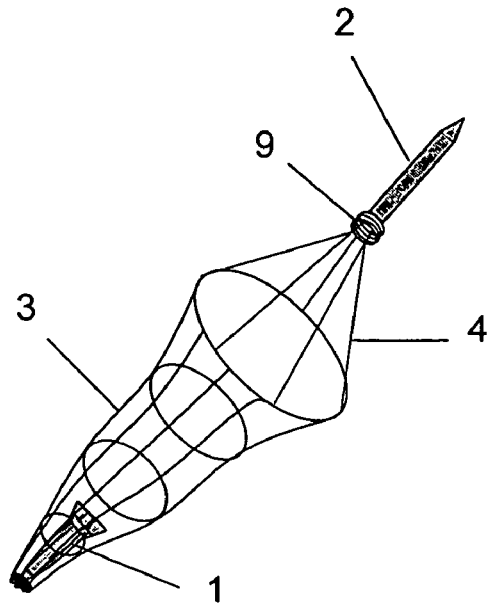
FIG. 9 is a depiction of one embodiment utilizing energy absorption devices to decelerate the RAM, consisting of FIG. 9*a* at the point of capture, and FIG. 9*b* showing ductile coils plastically deforming to absorb the energy of capture.
Figure 9B:
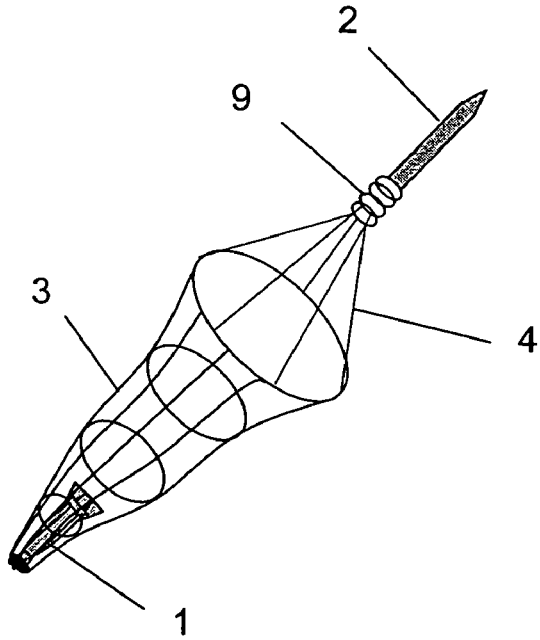

As depicted in FIG. 9, alternative embodiments also include the use of one or more energy absorption devices 9, for example, a coil. The energy absorption devices 9 could be utilized in connection with the capture sock 3 such that when the RAM 1 is captured, the capture sock 3 and its tethers 4 are used to decelerate the RAM 1 through the use of the energy absorption devices 9. For example, the tethers 4 could utilize one or more ductile coils in the connection to the interceptor 2 that plastically deform to absorb energy of capture (See FIG. 9). Alternatively, the portion of the interceptor 2 which houses the capture sock 3 could be connected to the main interceptor housing the coils, and as the RAM 1 is captured, the capture sock housing separates and decelerates the RAM 1 as the coils connecting the two housings extend.

Benefits of the capture sock include: (1) the requirement for high guidance precision to hit the target is considerably relaxed since the presented area of the sock opening allows for a larger miss distance; (2) capture and confinement of the RAM in the capture sock provides more opportunity to destroy or mitigate the RAM threat; (3) confinement in the sock presents opportunity to minimize collateral damage associated with defeating the RAM threat; and (4) visual confirmation that a RAM has been neutralized. The invention may greatly reduce the cost to kill a RAM threat by utilizing less expensive guidance hardware yet neutralizing various RAM threats.

Although a preferred embodiment of the invention has been described using specific terms and devices, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of various other embodiments may be interchanged both in whole or in part. Therefore, the spirit and scope of the appended claims should not be limited to the description of the preferred version contained herein.

What is claimed is:

1. A method of neutralizing an airborne enemy weapon comprising:

(a) launching an interceptor toward an approaching airborne enemy weapon, said interceptor having a deployable capture sock, said capture sock further comprising an open end and a closed end, and being generally conical in shape, said closed end further comprising an active destruct mechanism;

(b) deploying the capture sock just prior to the interceptor encountering the airborne enemy weapon said deployable capture sock remaining attached to the interceptor upon its deployment;

(c) capturing the airborne enemy weapon in the capture sock; and (d) detonating the active destruct mechanism.

2. The method of claim 1 wherein the capture sock is made of a para-aramid synthetic fiber.

3. The method of claim 1 further comprising the step of separating the capture sock from the interceptor after its active destruct mechanism is detonated.

4. The method of claim 1 further comprising the step of deploying a parachute from interceptor.

5. The method of claim 1 further comprising the step of utilizing propulsion from the interceptor to alter the trajectory of the captured airborne enemy weapon.

6. The method of claim 1 further comprising the step of decelerating the captured airborne enemy weapon through one or more energy absorption devices.

7. A weapon defense system for neutralizing an approaching airborne enemy weapon comprising an interceptor housing a deployable capture sock, said capture sock further comprising an open end, a closed end and being generally conical in shape, said closed end further comprising an active destruct mechanism, wherein the interceptor is launched toward the airborne enemy weapon and deploys the capture sock just prior to intercept of said enemy weapon, said deployable capture sock remaining attached to the interceptor upon its deployment to capture the airborne enemy weapon and detonating the active destruct mechanism.

8. The weapon defense system of claim 7 wherein the interceptor deploys a parachute after the airborne enemy weapon is captured.

* * * * *